US007096975B2

(12) United States Patent
Aronstam et al.

(10) Patent No.: US 7,096,975 B2
(45) Date of Patent: Aug. 29, 2006

(54) MODULAR DESIGN FOR DOWNHOLE ECD-MANAGEMENT DEVICES AND RELATED METHODS

(75) Inventors: Peter Aronstam, Houston, TX (US); Volker Krueger, Celle (DE); Sven Krueger, Winsen/Aller (DE); Harald Grimmer, Lachendorf (DE); Roger Fincher, Conroe, TX (US); Larry Watkins, Houston, TX (US); Peter Fontana, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 321 days.

(21) Appl. No.: 10/809,648

(22) Filed: Mar. 25, 2004

(65) Prior Publication Data

US 2004/0256161 A1 Dec. 23, 2004

Related U.S. Application Data

(63) Continuation-in-part of application No. 10/783,471, filed on Feb. 20, 2004, which is a continuation of application No. 10/251,138, filed on Sep. 20, 2002, now abandoned, application No. 10/809,648, and a continuation-in-part of application No. 10/716,106, filed on Nov. 17, 2003, now Pat. No. 6,854,532, which is a continuation of application No. 10/094,208, filed on Mar. 8, 2002, now Pat. No. 6,648,081, which is a continuation of application No. 09/353,275, filed on Jul. 14, 1999, now Pat. No. 6,415,877.

(60) Provisional application No. 60/323,803, filed on Sep. 20, 2001, provisional application No. 60/108,601, filed on Nov. 16, 1998, provisional application No. 60/101,541, filed on Sep. 23, 1998, provisional application No. 60/095,188, filed on Aug. 3, 1998, provisional application No. 60/092,908, filed on Jul. 15, 1998.

(51) Int. Cl.
*E21B 21/08* (2006.01)

(52) U.S. Cl. ..... 175/25; 175/48; 175/232

(58) Field of Classification Search ..... 175/25, 175/48, 65, 232
See application file for complete search history.

(56) References Cited

U.S. PATENT DOCUMENTS

| | | | |
|---|---|---|---|
| 2,812,723 | A | 11/1957 | Coberly |
| 2,946,565 | A | 7/1960 | Williams |
| 3,595,075 | A | 7/1971 | Dower |
| 3,603,409 | A | 9/1971 | Watkins |
| 3,677,353 | A | 7/1972 | Baker |
| 3,815,673 | A | 6/1974 | Bruce et al. |
| 3,958,651 | A | 5/1976 | Young |
| 4,022,285 | A | 5/1977 | Frank |
| 4,049,066 | A | 9/1977 | Richey |
| 4,063,602 | A | 12/1977 | Howell et al. |
| 4,091,881 | A | 5/1978 | Maus |
| 4,099,583 | A | 7/1978 | Maus |
| 4,108,257 | A | 8/1978 | Sizer |
| 4,134,461 | A | 1/1979 | Blomsma |
| 4,137,975 | A | 2/1979 | Pennock |
| 4,149,603 | A | 4/1979 | Arnold |
| 4,210,208 | A | 7/1980 | Shanks |
| 4,223,747 | A | 9/1980 | Marais |
| 4,240,513 | A | 12/1980 | Castel et al. |
| 4,291,772 | A | 9/1981 | Beynet |
| 4,368,787 | A | 1/1983 | Messenger |
| 4,436,166 | A | 3/1984 | Hayatdavoudi et al. |
| 4,440,239 | A | 4/1984 | Evans |
| 4,534,426 | A | 8/1985 | Hooper |
| 4,613,003 | A | 9/1986 | Ruhle |
| 4,630,691 | A | 12/1986 | Hooper |
| 4,744,426 | A | 5/1988 | Reed |
| 4,813,495 | A | 3/1989 | Leach |
| 5,150,757 | A | 9/1992 | Nunley |
| 5,168,932 | A | 12/1992 | Worrall et al. |
| 5,355,967 | A | 10/1994 | Mueller et al. |
| 5,651,420 | A | 7/1997 | Tibbitts et al. |
| 5,775,443 | A | 7/1998 | Lott |
| 6,142,236 | A | 11/2000 | Brammer et al. |

| | | | |
|---|---|---|---|
| 6,216,799 | B1 | 4/2001 | Gonzalez |
| 6,276,455 | B1 | 8/2001 | Gonzalez |
| 6,374,925 | B1 | 4/2002 | Elkins et al. |
| 6,415,877 | B1 | 7/2002 | Fincher et al. |
| 2003/0146001 | A1 | 8/2003 | Hosie et al. |

FOREIGN PATENT DOCUMENTS

| | | |
|---|---|---|
| CA | WO 02/14649 | 2/2002 |
| EP | 0293251 | 3/1988 |
| EP | 0290250 | 9/1988 |
| WO | WO 00/50731 | 8/2000 |
| WO | WO 03/023182 | 3/2003 |
| WO | WO 03/023182 A1 | 3/2003 |
| WO | WO 03/025336 | 3/2003 |

OTHER PUBLICATIONS

*Continuous Circulation Drilling*, L.J. Ayling, Maris Int'l Ltd.; J.W. Jenner, Maris Int'l Ltd., H. Elkins, Varco Drilling Equipment, this paper prepared for presentation at the 2002 Offshore Technology Conference, Houston, Texas May 6-9, 2002.

*New Tool Addresses ECD Problem*, William Furlow, Offshore, pp. 88, 89, Jun. 2002.

*Technologies Manage Well Pressures*, Don M. Hannegan, Ron Divine, The American Oil & Gas Reporter, Sep. 2001.

*Primary Examiner*—Frank Tsay
(74) *Attorney, Agent, or Firm*—Madan, Mossman & Sriram, P.C.

(57) ABSTRACT

One or more components of a wellbore drilling assembly utilize a modular construction to facilitate assembly, disassembly, repair and/or maintenance of a wellbore drilling assembly and/or to extend the overall operating capabilities of the drilling assembly. In one embodiment, a modular construction is used for an APD Device, a motor driving the modular APD Device, a comminution device, and an annular seal. Individual modules can be configure have different operating set points, operating parameters and characteristics (e.g., rotational speeds, flow rates, pressure differentials, etc.) and/or different responses to given environmental factors or conditions (e.g., pressure, temperature, wellbore fluid chemistry, etc.). In one embodiment, the high-pressure seals used in conjunction with the APD Device and/or motor is a hydrodynamic seal that provides a selected leak or flow rates. Optionally, the seal is modular to provide different degrees of leak rates and/or different functional characteristics.

30 Claims, 9 Drawing Sheets

MODULAR DESIGN FOR DOWNHOLE ECD-MANAGEMENT DEVICES AND RELATED METHODS

CROSS-REFERENCE TO RELATED APPLICATIONS

This application is a continuation-in-part of U.S. patent application Ser. No. 10/783,471 filed Feb. 20, 2004, which is a continuation of U.S. patent application Ser. No. 10/251,138 filed Sep. 20, 2002, now abandoned, which takes priority from U.S. provisional patent application Ser. No. 60/323,803 filed on Sep. 20, 2001, titled "Active Controlled Bottomhole Pressure System and Method."

This application is a continuation-in-part of U.S. patent application Ser. No. 10/716,106 filed on Nov. 17, 2003, now U.S. Pat. No. 6,854,532, which is a continuation of U.S. patent application Ser. No. 10/094,208, filed Mar. 8, 2002, now U.S. Pat. No. 6,648,081 granted on Nov. 18, 2003, which is a continuation of U.S. application Ser. No. 09/353,275, filed Jul. 14, 1999, now U.S. Pat. No. 6,415,877, which claims benefit of U.S. Provisional Application No. 60/108,601, filed Nov. 16, 1998, U.S. Provisional Application No. 60/101,541, filed Sep. 23, 1998, U.S. Provisional Application No. 60/092,908, filed, Jul. 15, 1998 and U.S. Provisional Application No. 60/095,188, filed Aug. 3, 1998.

FIELD OF THE INVENTION

This invention relates generally to oilfield wellbore drilling systems and more particularly to drilling systems that utilize active control of bottomhole pressure or equivalent circulating density during drilling of the wellbores.

BACKGROUND OF THE ART

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from a source at the surface down the tubing. The drilling fluid drives the mud motor and then discharges at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

For drilling wellbores under water (referred to in the industry as "offshore" or "subsea" drilling) tubing is provided at a work station (located on a vessel or platform). One or more tubing injectors or rigs are used to move the tubing into and out of the wellbore. In riser-type drilling, a riser, which is formed by joining sections of casing or pipe, is deployed between the drilling vessel and the wellhead equipment at the sea bottom and is utilized to guide the tubing to the wellhead. The riser also serves as a conduit for fluid returning from the wellhead to the sea surface.

During drilling, the drilling operator attempts to carefully control the fluid density at the surface so as to control pressure in the wellbore, including the bottomhole pressure. Typically, the operator maintains the hydrostatic pressure of the drilling fluid in the wellbore above the formation or pore pressure to avoid well blow-out. The density of the drilling fluid and the fluid flow rate largely determine the effectiveness of the drilling fluid to carry the cuttings to the surface. One important downhole parameter controlled during drilling is the bottomhole pressure, which in turn controls the equivalent circulating density ("ECD") of the fluid at the wellbore bottom.

This term, ECD, describes the condition that exists when the drilling mud in the well is circulated. The friction pressure caused by the fluid circulating through the open hole and the casing(s) on its way back to the surface, causes an increase in the pressure profile along this path that is different from the pressure profile when the well is in a static condition (i.e., not circulating). In addition to the increase in pressure while circulating, there is an additional increase in pressure while drilling due to the introduction of drill solids into the fluid. This negative effect of the increase in pressure along the annulus of the well is an increase of the pressure which can fracture the formation at the shoe of the last casing. This can reduce the amount of hole that can be drilled before having to set an additional casing. In addition, the rate of circulation that can be achieved is also limited. Also, due to this circulating pressure increase, the ability to clean the hole is severely restricted. This condition is exacerbated when drilling an offshore well. In offshore wells, the difference between the fracture pressures in the shallow sections of the well and the pore pressures of the deeper sections is considerably smaller compared to on shore wellbores. This is due to the seawater gradient versus the gradient that would exist if there were soil overburden for the same depth.

In some drilling applications, it is desired to drill the wellbore at at-balance condition or at under-balanced condition. The term at-balance means that the pressure in the wellbore is maintained at or near the formation pressure. The under-balanced condition means that the wellbore pressure is below the formation pressure. These two conditions are desirable because the drilling fluid under such conditions does not penetrate into the formation, thereby leaving the formation virgin for performing formation evaluation tests and measurements. In order to be able to drill a well to a total wellbore depth at the bottomhole, ECD must be reduced or controlled. In subsea wells, one approach is to use a mud-filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed, but not used in practical application. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling)

would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed (if not altogether prevented) the practical application of the "dual gradient" system.

Another approach is described in U.S. patent application Ser. No. 09/353,275, filed on Jul. 14, 1999 and assigned to the assignee of the present application. The U.S. patent application Ser. No. 09/353,275 is incorporated herein by reference in its entirety. One embodiment of this application describes a riser less system wherein a centrifugal pump in a separate return line controls the fluid flow to the surface and thus the equivalent circulating density.

The present invention provides a wellbore system wherein the bottomhole pressure and hence the equivalent circulating density is controlled by creating a pressure differential at a selected location in the return fluid path with an active pressure differential device to reduce or control the bottomhole pressure. The present system is relatively easy to incorporate in new and existing systems.

SUMMARY OF THE INVENTION

The present invention provides wellbore systems for performing downhole wellbore operations for both land and offshore wellbores. Such drilling systems include a rig that moves an umbilical (e.g., drill string) into and out of the wellbore. A bottomhole assembly, carrying the drill bit, is attached to the bottom end of the drill string. A well control assembly or equipment on the well receives the bottomhole assembly and the tubing. A drilling fluid system supplies a drilling fluid into the tubing, which discharges at the drill bit and returns to the well control equipment carrying the drill cuttings via the annulus between the drill string and the wellbore. A riser dispersed between the wellhead equipment and the surface guides the drill string and provides a conduit for moving the returning fluid to the surface.

In one embodiment of the present invention, an active pressure differential device moves in the wellbore as the drill string is moved. In an alternative embodiment, the active differential pressure device is attached to the wellbore inside or wall and remains stationary relative to the wellbore during drilling. The device is operated during drilling, i.e., when the drilling fluid is circulating through the wellbore, to create a pressure differential across the device. This pressure differential alters the pressure on the wellbore below or downhole of the device. The device may be controlled to reduce the bottomhole pressure by a certain amount, to maintain the bottomhole pressure at a certain value, or within a certain range. By severing or restricting the flow through the device, the bottomhole pressure may be increased.

The system also includes downhole devices for performing a variety of functions. Exemplary downhole devices include devices that control the drilling flow rate and flow paths. For example, the system can include one or more flow-control devices that can stop the flow of the fluid in the drill string and/or the annulus. Such flow-control devices can be configured to direct fluid in drill string into the annulus and/or bypass return fluid around the APD device. Another exemplary downhole device can be configured for processing the cuttings (e.g., reduction of cutting size) and other debris flowing in the annulus. For example, a comminution device can be disposed in the annulus upstream of the APD device.

In a preferred embodiment, sensors communicate with a controller via a telemetry system to maintain the wellbore pressure at a zone of interest at a selected pressure or range of pressures. The sensors are strategically positioned throughout the system to provide information or data relating to one or more selected parameters of interest such as drilling parameters, drilling assembly or BHA parameters, and formation or formation evaluation parameters. The controller for suitable for drilling operations preferably includes programs for maintaining the wellbore pressure at zone at under-balance condition, at at-balance condition or at over-balanced condition. The controller may be programmed to activate downhole devices according to programmed instructions or upon the occurrence of a particular condition.

Exemplary configurations for the APD Device and associated drive includes a moineau-type pump coupled to positive displacement motor/drive via a shaft assembly. Another exemplary configuration includes a turbine drive coupled to a centrifugal-type pump via a shaft assembly. Preferably, a high-pressure seal separates a supply fluid flowing through the motor from a return fluid flowing through the pump. In a preferred embodiment, the seal is configured to bear either or both of radial and axial (thrust) forces.

In still other configurations, a positive displacement motor can drive an intermediate device such as a hydraulic motor, which drives the APD Device. Alternatively, a jet pump can be used, which can eliminate the need for a drive/motor. Moreover, pumps incorporating one or more pistons, such as hammer pumps, may also be suitable for certain applications. In still other configurations, the APD Device can be driven by an electric motor. The electric motor can be positioned external to a drill string or formed integral with a drill string. In a preferred arrangement, varying the speed of the electrical motor directly controls the speed of the rotor in the APD device, and thus the pressure differential across the APD Device.

Bypass devices are provided to allow fluid circulation in the wellbore during tripping of the system, to control the operating set points of the APD Device and/or associated drive/motor, and to provide a discharge mechanism to relieve fluid pressure. For examples, the bypass devices can selectively channel fluid around the motor/drive and the APD Device and selectively discharge drilling fluid from the drill string into the annulus. In one arrangement, the bypass device for the pump can also function as a particle bypass line for the APD device. Alternatively, a separate particle bypass can be used in addition to the pump bypass for such a function. Additionally, an annular seal (not shown) in certain embodiments can be disposed around the APD device to enable a pressure differential across the APD Device.

In certain embodiments of the present invention, one or more of the above-described components utilize a modular construction (i.e., formed as modules having a standardized construction). Modular construction facilitates repair and/or maintenance of a wellbore drilling assembly by enabling the component needing work to be readily removed from the drilling assembly. Additionally, the modular construction can enhance the overall operating capabilities of the drilling assembly. Generally speaking, components of a drilling assembly have operating set points, operating parameters and characteristics that, if changed, can increase or decrease overall drilling efficiency. An exemplary, but not exclusive, list of such set points, operating parameters and characteristics includes: rotational speed, pressure differentials in the supply fluid or return fluid, torque output, and fluid flow rate. Moreover, the drilling environment can also impact drilling efficiency. Exemplary environmental factors or conditions that influence drilling efficiency include loadings (stress, strain), temperature, wellbore fluid chemistry, cutting composition, and volume of cuttings in the return fluid. Modular components that are configured to have a specified operating parameter or operate in a particular environmental condition can be changed out as environmental conditions change and/or as different operating parameters are needed to provide optimal operation.

By way of illustration, components of a wellbore drilling assembly that are amenable to modular construction include the APD Device, the motor driving the modular APD Device, the comminution device, and the annular seal. Suitable modular pumps can be configured to operate at different rotational speeds, flow rates, and pressure differentials. Other embodiments of modular pumps can generate the given pressure differential using multiple stages. Modular motors can be designed to have different operating RPM and/or torque. Modular comminution devices can be configured for optimal performance under a different operating parameter such a selected flow rate, cutting composition, rotational speed of the driving mechanism, and volume of cuttings in the return fluid. Modular annular seals can be constructed for specified wellbore diameters or ranges of wellbore diameters as well as environmental conditions such as wellbore pressures and wellbore fluid chemistry.

Modular construction can also be extended to other aspects of the drilling assembly, such as internal seals. For instance, the high-pressure seals used in conjunction with the APD Device and/or motor can be a hydrodynamic seal that provides a selected leak or flow rates. In one embodiment, the seal includes a concentrically arranged inner sleeve and outer sleeve. A gap between the inner sleeve and the outer sleeve permits a predetermined or specified amount of drilling fluid to leak through between the concentric sleeves. Different seal modules can provide different degrees of leak rates. The different seal modules can also be configured have different functional characteristics such as radial support.

Thus, it should be appreciated that for a given drilling environment, the appropriate configuration or re-configuration of one or more modules in the wellbore drilling system can enhance drilling efficiency and increase system life by reducing sub-optimal operation.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing.

DETAILED DESCRIPTION OF PREFERRED EMBODIMENTS

Figure 1A:
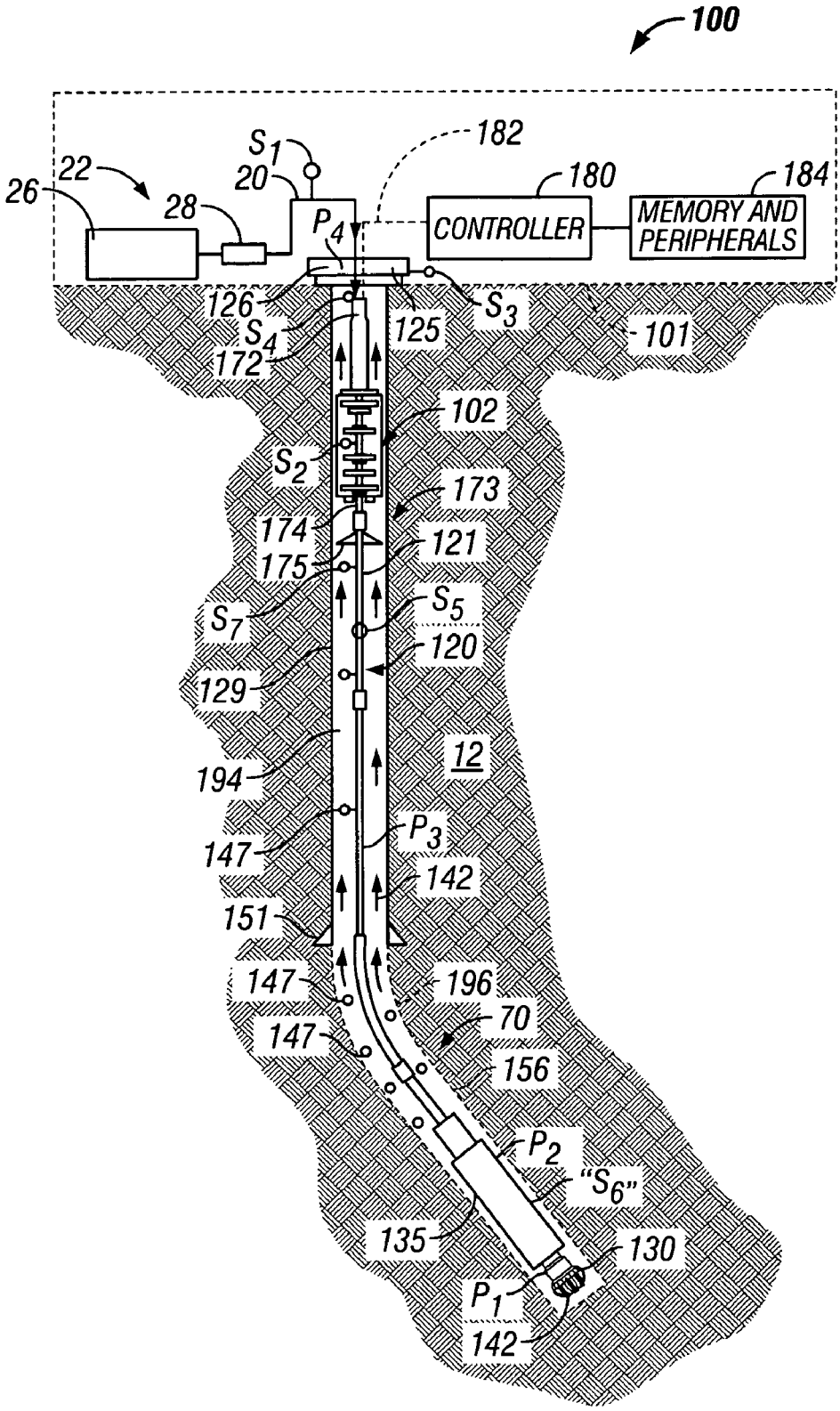
FIG. 1A is a schematic illustration of one embodiment of a system using an active pressure differential device to manage pressure in a predetermined wellbore location.

Referring initially to FIG. 1A, there is schematically illustrated a system for performing one or more operations related to the construction, logging, completion or workover of a hydrocarbon producing well. In particular, FIG. 1A shows a schematic elevation view of one embodiment of a wellbore drilling system 100 for drilling wellbore 90 using conventional drilling fluid circulation. The drilling system 100 is a rig for land wells and includes a drilling platform 101, which may be a drill ship or another suitable surface workstation such as a floating platform or a semi-submersible for offshore wells. For offshore operations, additional known equipment such as a riser and subsea wellhead will typically be used. To drill a wellbore 90, well control equipment 125 (also referred to as the wellhead equipment) is placed above the wellbore 90. The wellhead equipment 125 includes a blow-out-preventer stack 126 and a lubricator (not shown) with its associated flow control.

This system 100 further includes a well tool such as a drilling assembly or a bottomhole assembly ("BHA") 135 at the bottom of a suitable umbilical such as drill string or tubing 121 (such terms will be used interchangeably). In a preferred embodiment, the BHA 135 includes a drill bit 130 adapted to disintegrate rock and earth. The bit can be rotated by a surface rotary drive or a motor using pressurized fluid (e.g., mud motor) or an electrically driven motor. The tubing 121 can be formed partially or fully of drill pipe, metal or composite coiled tubing, liner, casing or other known members. Additionally, the tubing 121 can include data and power transmission carriers such fluid conduits, fiber optics, and metal conductors. Conventionally, the tubing 121 is placed at the drilling platform 101. To drill the wellbore 90, the BHA 135 is conveyed from the drilling platform 101 to the wellhead equipment 125 and then inserted into the wellbore 90. The tubing 121 is moved into and out of the wellbore 90 by a suitable tubing injection system.

During drilling, a drilling fluid from a surface mud system 22 is pumped under pressure down the tubing 121 (a "supply fluid"). The mud system 22 includes a mud pit or supply source 26 and one or more pumps 28. In one embodiment, the supply fluid operates a mud motor in the BHA 135, which in turn rotates the drill bit 130. The drill string 121 rotation can also be used to rotate the drill bit 130, either in conjunction with or separately from the mud motor. The drill bit 130 disintegrates the formation (rock) into cuttings 147. The drilling fluid leaving the drill bit travels uphole through the annulus 194 between the drill string 121 and the wellbore wall or inside 196, carrying the drill cuttings 147 therewith (a "return fluid"). The return fluid discharges into a separator (not shown) that separates the cuttings 147 and other solids from the return fluid and discharges the clean fluid back into the mud pit 26. As shown in FIG. 1A, the clean mud is pumped through the tubing 121 while the mud with cuttings 147 returns to the surface via the annulus 194 up to the wellhead equipment 125.

Once the well 90 has been drilled to a certain depth, casing 129 with a casing shoe 151 at the bottom is installed. The drilling is then continued to drill the well to a desired depth that will include one or more production sections, such as section 155. The section below the casing shoe 151 may not be cased until it is desired to complete the well, which leaves the bottom section of the well as an open hole, as shown by numeral 156.

As noted above, the present invention provides a drilling system for controlling bottomhole pressure at a zone of interest designated by the numeral 155 and thereby the ECD effect on the wellbore. In one embodiment of the present invention, to manage or control the pressure at the zone 155, an active pressure differential device ("APD Device") 170 is fluidicly coupled to return fluid downstream of the zone of interest 155. The active pressure differential device is a device that is capable of creating a pressure differential "ΔP" across the device. This controlled pressure drop reduces the pressure upstream of the APD Device 170 and particularly in zone 155.

The system 100 also includes downhole devices that separately or cooperatively perform one or more functions such as controlling the flow rate of the drilling fluid and controlling the flow paths of the drilling fluid. For example, the system 100 can include one or more flow-control devices that can stop the flow of the fluid in the drill string and/or the annulus 194. FIG. 1A shows an exemplary flow-control device 173 that includes a device 174 that can block the fluid flow within the drill string 121 and a device 175 that blocks can block fluid flow through the annulus 194. The device 173 can be activated when a particular condition occurs to insulate the well above and below the flow-control device 173. For example, the flow-control device 173 may be activated to block fluid flow communication when drilling fluid circulation is stopped so as to isolate the sections above and below the device 173, thereby maintaining the wellbore below the device 173 at or substantially at the pressure condition prior to the stopping of the fluid circulation.

The flow-control devices 174, 175 can also be configured to selectively control the flow path of the drilling fluid. For example, the flow-control device 174 in the drill pipe 121 can be configured to direct some or all of the fluid in drill string 121 into the annulus 194. Moreover, one or both of the flow-control devices 174, 175 can be configured to bypass some or all of the return fluid around the APD device 170. Such an arrangement may be useful, for instance, to assist in lifting cuttings to the surface. The flow-control device 173 may include check-valves, packers and any other suitable device. Such devices may automatically activate upon the occurrence of a particular event or condition.

The system 100 also includes downhole devices for processing the cuttings (e.g., reduction of cutting size) and other debris flowing in the annulus 194. For example, a comminution device 176 can be disposed in the annulus 194 upstream of the APD device 170 to reduce the size of entrained cutting and other debris. The comminution device 176 can use known members such as blades, teeth, or rollers to crush, pulverize or otherwise disintegrate cuttings and debris entrained in the fluid flowing in the annulus 194. The comminution device 176 can be operated by an electric motor, a hydraulic motor, by rotation of drill string or other suitable means. The comminution device 176 can also be integrated into the APD device 170. For instance, if a multi-stage turbine is used as the APD device 170, then the stages adjacent the inlet to the turbine can be replaced with blades adapted to cut or shear particles before they pass through the blades of the remaining turbine stages.

Sensors $S_{1-n}$ are strategically positioned throughout the system 100 to provide information or data relating to one or more selected parameters of interest (pressure, flow rate, temperature). In a preferred embodiment, the downhole devices and sensors $S_{1-n}$ communicate with a controller 180 via a telemetry system (not shown). Using data provided by the sensors $S_{1-n}$, the controller 180 maintains the wellbore pressure at zone 155 at a selected pressure or range of pressures. The controller 180 maintains the selected pressure by controlling the APD device 170 (e.g., adjusting amount of energy added to the return fluid line) and/or the downhole devices (e.g., adjusting flow rate through a restriction such as a valve).

When configured for drilling operations, the sensors $S_{1-n}$ provide measurements relating to a variety of drilling parameters, such as fluid pressure, fluid flow rate, rotational speed of pumps and like devices, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. One preferred type of sensor is a pressure sensor for measuring pressure at one or more locations. Referring still to FIG. 1A, pressure sensor $P_1$ provides pressure data in the BHA, sensor $P_2$ provides pressure data in the annulus, pressure sensor $P_3$ in the supply fluid, and pressure sensor $P_4$ provides pressure data at the surface. Other pressure sensors may be used to provide pressure data at any other desired place in the system 100. Additionally, the system 100 includes fluid flow sensors such as sensor V that provides measurement of fluid flow at one or more places in the system.

Further, the status and condition of equipment as well as parameters relating to ambient conditions (e.g., pressure and other parameters listed above) in the system 100 can be monitored by sensors positioned throughout the system 100: exemplary locations including at the surface (S1), at the APD device 170 (S2), at the wellhead equipment 125 (S3), in the supply fluid (S4), along the tubing 121 (S5), at the well tool 135 (S6), in the return fluid upstream of the APD device 170 (S7), and in the return fluid downstream of the APD device 170 (S8). It should be understood that other locations may also be used for the sensors $S_{1-n}$.

The controller 180 for suitable for drilling operations preferably includes programs for maintaining the wellbore pressure at zone 155 at under-balance condition, at at-balance condition or at over-balanced condition. The controller 180 includes one or more processors that process signals from the various sensors in the drilling assembly and also controls their operation. The data provided by these sensors $S_{1-n}$ and control signals transmitted by the controller 180 to control downhole devices such as devices 173–176 are communicated by a suitable two-way telemetry system (not shown). A separate processor may be used for each sensor or device. Each sensor may also have additional circuitry for its unique operations. The controller 180, which may be either downhole or at the surface, is used herein in the generic sense for simplicity and ease of understanding and not as a limitation because the use and operation of such controllers is known in the art. The controller 180 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 30, downhole devices such as devices 173–175 and the surface equipment via the two-way telemetry. In other embodiments, the controller 180 can be a hydro-mechanical device that incorporates known mechanisms (valves, biased members, linkages cooperating to actuate tools under, for example, preset conditions).

For convenience, a single controller 180 is shown. It should be understood, however, that a plurality of controllers 180 can also be used. For example, a downhole controller can be used to collect, process and transmit data to a surface controller, which further processes the data and transmits appropriate control signals downhole. Other variations for dividing data processing tasks and generating control signals can also be used.

In general, however, during operation, the controller 180 receives the information regarding a parameter of interest and adjusts one or more downhole devices and/or APD device 170 to provide the desired pressure or range or pressure in the vicinity of the zone of interest 155. For example, the controller 180 can receive pressure information from one or more of the sensors ($S_1$–$S_n$) in the system 100. The controller 180 may control the APD Device 170 in response to one or more of: pressure, fluid flow, a formation characteristic, a wellbore characteristic and a fluid characteristic, a surface measured parameter or a parameter measured in the drill string. The controller 180 determines the ECD and adjusts the energy input to the APD device 170 to maintain the ECD at a desired or predetermined value or within a desired or predetermined range. The wellbore system 100 thus provides a closed loop system for controlling the ECD in response to one or more parameters of interest during drilling of a wellbore. This system is relatively simple and efficient and can be incorporated into new or existing drilling systems and readily adapted to support other well construction, completion, and work-over activities.

In the embodiment shown in FIG. 1A, the APD Device 170 is shown as a turbine attached to the drill string 121 that operates within the annulus 194. Other embodiments, described in further detail below can include centrifugal pumps, positive displacement pump, jet pumps and other like devices. During drilling, the APD Device 170 moves in the wellbore 90 along with the drill string 121. The return fluid can flow through the APD Device 170 whether or not the turbine is operating. However, the APD Device 170, when operated creates a differential pressure thereacross.

As described above, the system 100 in one embodiment includes a controller 180 that includes a memory and peripherals 184 for controlling the operation of the APD Device 170, the devices 173–176, and/or the bottomhole assembly 135. In FIG. 1A, the controller 180 is shown placed at the surface. It, however, may be located adjacent the APD Device 170, in the BHA 135 or at any other suitable location. The controller 180 controls the APD Device to create a desired amount of $\Delta P$ across the device, which alters the bottomhole pressure accordingly. Alternatively, the controller 180 may be programmed to activate the flow-control device 173 (or other downhole devices) according to programmed instructions or upon the occurrence of a particular condition. Thus, the controller 180 can control the APD Device in response to sensor data regarding a parameter of interest, according to programmed instructions provided to said APD Device, or in response to instructions provided to said APD Device from a remote location. The controller 180 can, thus, operate autonomously or interactively.

During drilling, the controller 180 controls the operation of the APD Device to create a certain pressure differential across the device so as to alter the pressure on the formation or the bottomhole pressure. The controller 180 may be programmed to maintain the wellbore pressure at a value or range of values that provide an under-balance condition, an at-balance condition or an over-balanced condition. In one embodiment, the differential pressure may be altered by altering the speed of the APD Device. For instance, the bottomhole pressure may be maintained at a preselected value or within a selected range relative to a parameter of interest such as the formation pressure. The controller 180 may receive signals from one or more sensors in the system 100 and in response thereto control the operation of the APD Device to create the desired pressure differential. The controller 180 may contain pre-programmed instructions and autonomously control the APD Device or respond to signals received from another device that may be remotely located from the APD Device.

Figure 1B:
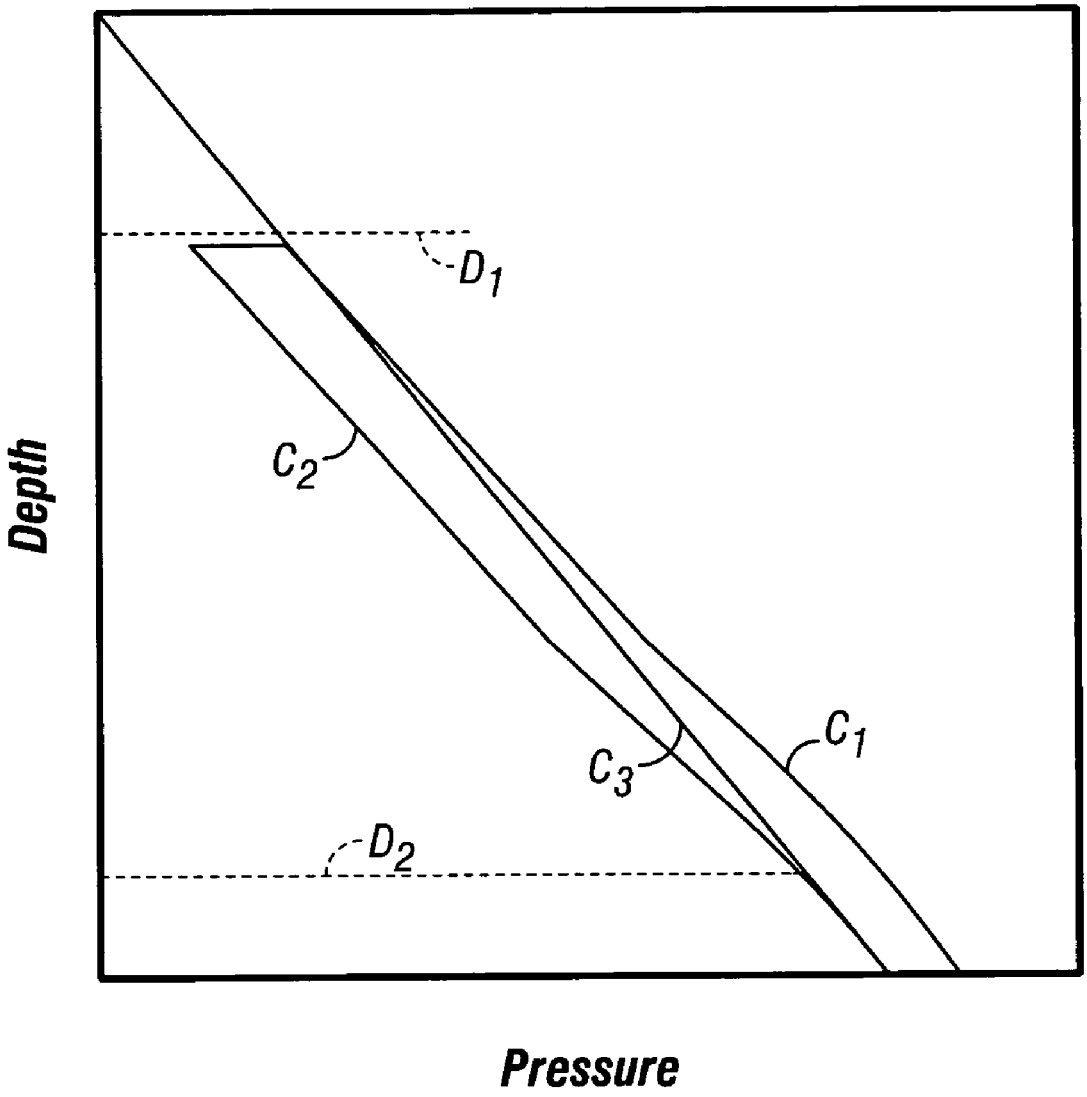
FIG. 1B graphically illustrates the effect of an operating active pressure differential device upon the pressure at a predetermined wellbore location.

FIG. 1B graphically illustrates the ECD control provided by the above-described embodiment of the present invention and references FIG. 1A for convenience. FIG. 1A shows the APD device 170 at a depth D1 and a representative location in the wellbore in the vicinity of the well tool 30 at a lower depth D2. FIG. 1B provides a depth versus pressure graph having a first curve C1 representative of a pressure gradient before operation of the system 100 and a second curve C2 representative of a pressure gradients during operation of the system 100. Curve C3 represents a theoretical curve wherein the ECD condition is not present; i.e., when the well is static and not circulating and is free of drill cuttings. It will be seen that a target or selected pressure at depth D2 under curve C3 cannot be met with curve C1. Advantageously, the system 100 reduces the hydrostatic pressure at depth D1 and thus shifts the pressure gradient as shown by curve C3, which can provide the desired predetermined pressure at depth D2. In most instances, this shift is roughly the pressure drop provided by the APD device 170.

Figure 2:
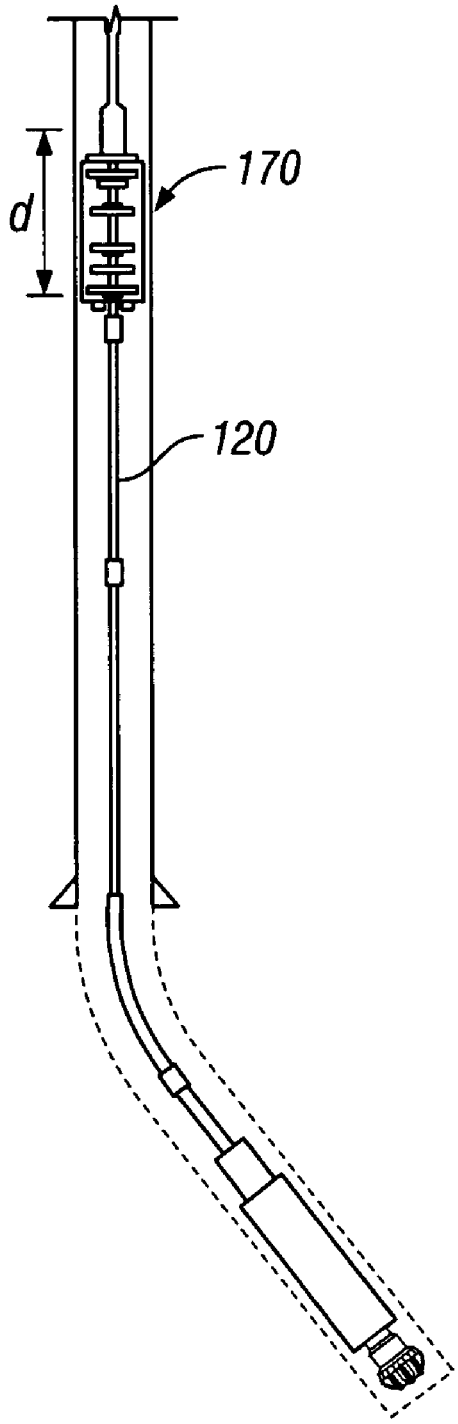
FIG. 2 is a schematic elevation view of FIG. 1A after the drill string and the active pressure differential device have moved a certain distance in the earth formation from the location shown in FIG. 1A.

FIG. 2 shows the drill string after it has moved the distance "d" shown by $t_1$–$t_2$. Since the APD Device 170 is attached to the drill string 121, the APD Device 170 also is shown moved by the distance d.

Figure 3:
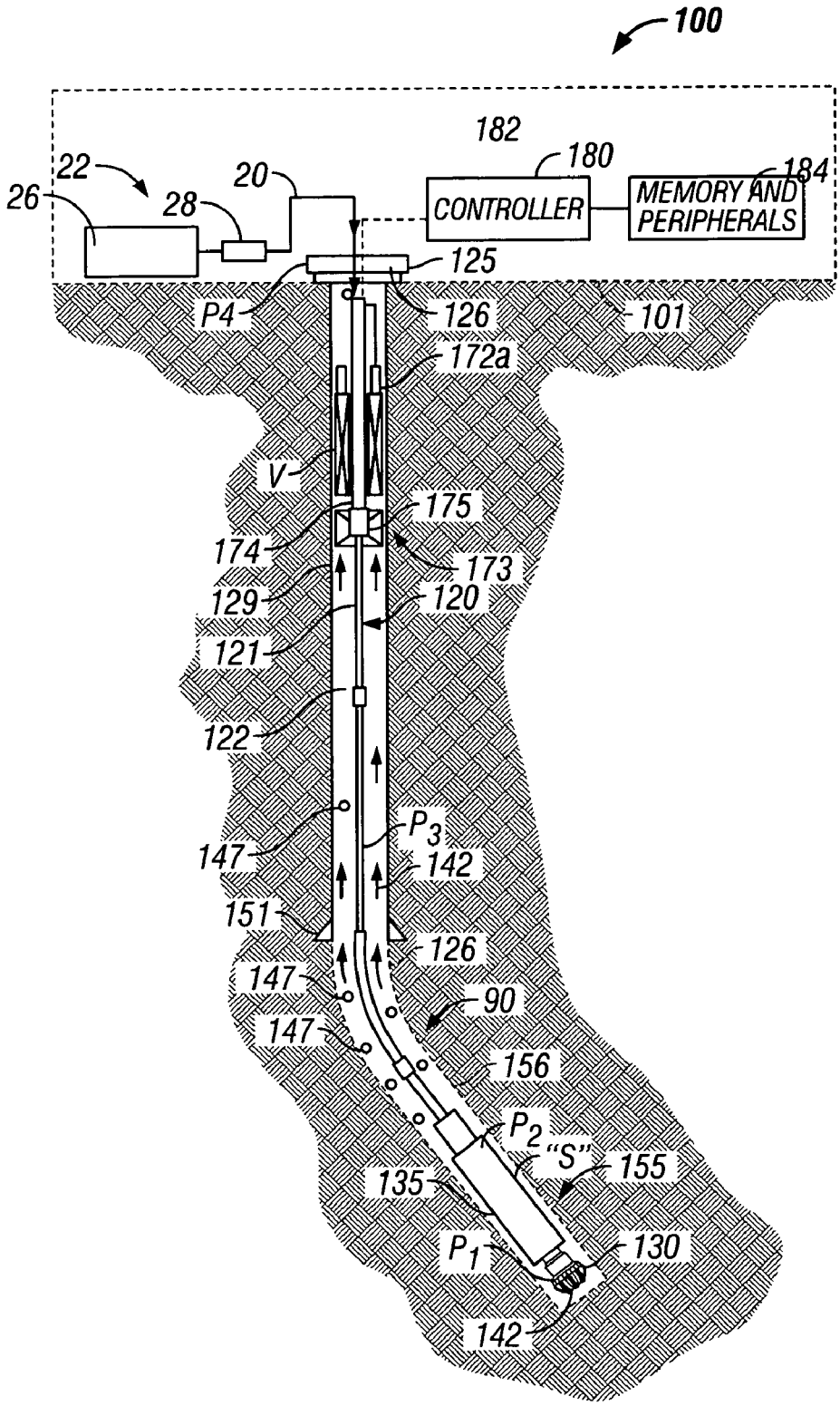
FIG. 3 is a schematic elevation view of an alternative embodiment of the wellbore system wherein the active pressure differential device is attached to the wellbore inside.
Figure 4A:
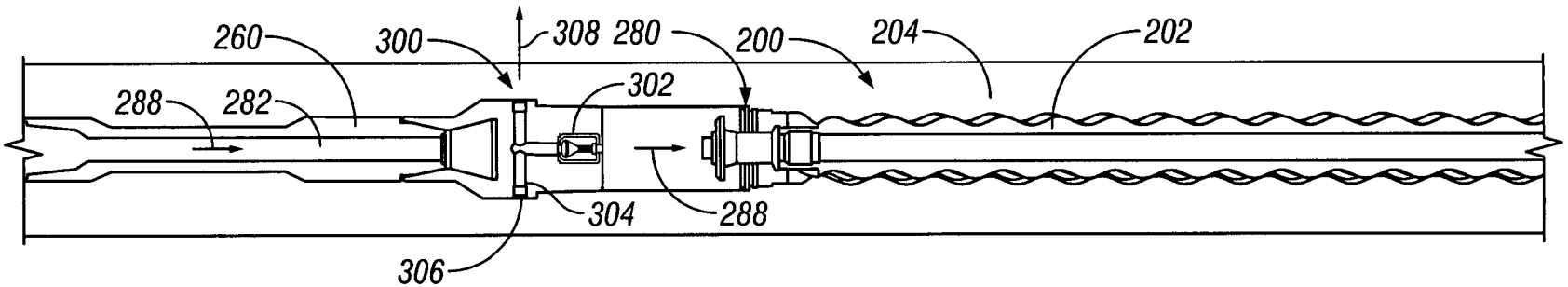
FIGS. 4A–D are schematic illustrations of one embodiment of an arrangement according to the present invention wherein a positive displacement motor is coupled to a positive displacement pump (the APD Device)
Figure 4B:
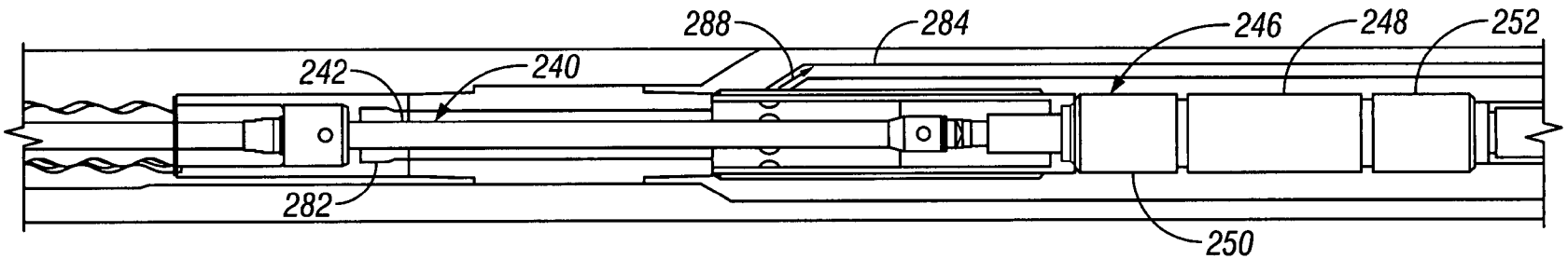
Figure 4C:
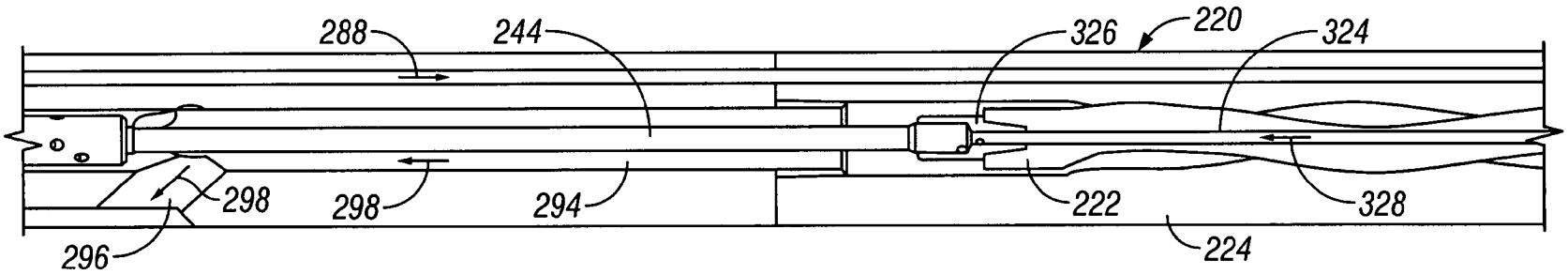
Figure 4D:
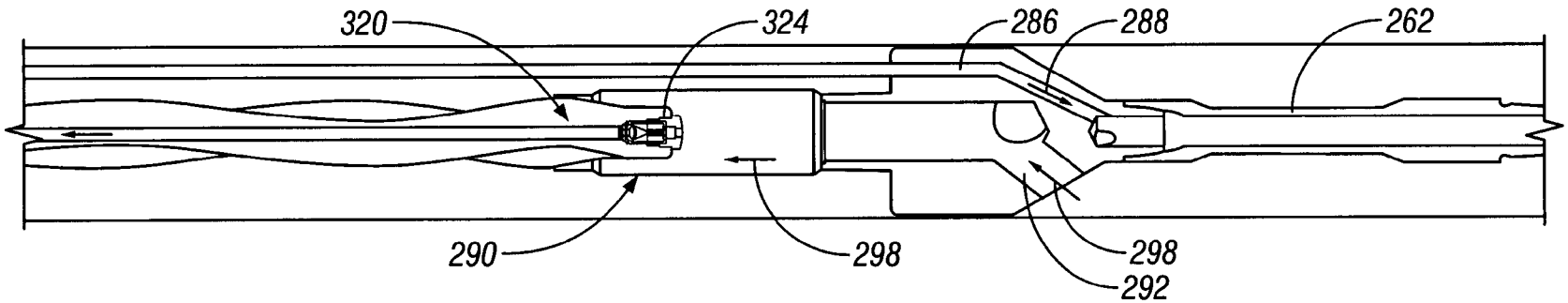

As noted earlier and shown in FIG. 2, an APD Device 170*a* may be attached to the wellbore in a manner that will allow the drill string 121 to move while the APD Device 170*a* remains at a fixed location. FIG. 3 shows an embodiment wherein the APD Device is attached to the wellbore inside and is operated by a suitable device 172*a*. Thus, the APD device can be attached to a location stationary relative to said drill string such as a casing, a liner, the wellbore annulus, a riser, or other suitable wellbore equipment. The APD Device 170*a* is preferably installed so that it is in a cased upper section 129. The device 170*a* is controlled in the manner described with respect to the device 170 (FIG. 1A).

Referring now to FIGS. 4A–D, there is schematically illustrated one arrangement wherein a positive displacement motor/drive 200 is coupled to a moineau-type pump 220 via a shaft assembly 240. The motor 200 is connected to an upper string section 260 through which drilling fluid is pumped from a surface location. The pump 220 is connected to a lower drill string section 262 on which the bottomhole assembly (not shown) is attached at an end thereof. The motor 200 includes a rotor 202 and a stator 204. Similarly, the pump 220 includes a rotor 222 and a stator 224. The design of moineau-type pumps and motors are known to one skilled in the art and will not be discussed in further detail.

The shaft assembly 240 transmits the power generated by the motor 200 to the pump 220. One preferred shaft assembly 240 includes a motor flex shaft 242 connected to the motor rotor 202, a pump flex shaft 244 connected to the pump rotor 224, and a coupling shaft 246 for joining the first and second shafts 242 and 244. In one arrangement, a high-pressure seal 248 is disposed about the coupling shaft 246. As is known, the rotors for moineau-type motors/pump are subject to eccentric motion during rotation. Accordingly, the coupling shaft 246 is preferably articulated or formed sufficiently flexible to absorb this eccentric motion. Alternately or in combination, the shafts 242, 244 can be configured to flex to accommodate eccentric motion. Radial and axial forces can be borne by bearings 250 positioned along the shaft assembly 240. In a preferred embodiment, the seal 248 is configured to bear either or both of radial and axial (thrust) forces. In certain arrangements, a speed or torque converter 252 can be used to convert speed/torque of the motor 200 to a second speed/torque for the pump 220. By speed/torque converter it is meant known devices such as variable or fixed ratio mechanical gearboxes, hydrostatic torque converters, and a hydrodynamic converters. It should be understood that any number of arrangements and devices can be used to transfer power, speed, or torque from the motor 200 to the pump 220. For example, the shaft assembly 240 can utilize a single shaft instead of multiple shafts.

As described earlier, a comminution device can be used to process entrained cutting in the return fluid before it enters the pump 200. Such a comminution device (FIG. 1A) can be coupled to the drive 200 or pump 220 and operated thereby. For instance, one such comminution device or cutting mill 270 can include a shaft 272 coupled to the pump rotor 224. The shaft 272 can include a conical head or hammer element 274 mounted thereon. During rotation, the eccentric motion of the pump rotor 224 will cause a corresponding radial motion of the shaft head 274. This radial motion can be used to resize the cuttings between the rotor and a comminution device housing 276.

The FIGS. 4A–D arrangement also includes a supply flow path 290 to carry supply fluid from the device 200 to the lower drill string section 262 and a return flow path 292 to channel return fluid from the casing interior or annulus into and out of the pump 220. The high pressure seal 248 is interposed between the flow paths 290 and 292 to prevent fluid leaks, particularly from the high pressure fluid in the supply flow path 290 into the return flow path 292. The seal 248 can be a high-pressure seal, a hydrodynamic seal or other suitable seal and formed of rubber, an elastomer, metal or composite.

Additionally, bypass devices are provided to allow fluid circulation during tripping of the downhole devices of the system 100 (FIG. 1A), to control the operating set points of the motor 200 and pump 220, and to provide safety pressure relief along either or both of the supply flow path 290 and the return flow path 292. Exemplary bypass devices include a circulation bypass 300, motor bypass 310, and a pump bypass 320.

The circulation bypass 300 selectively diverts supply fluid into the annulus 194 (FIG. 1A) or casing C interior. The circulation bypass 300 is interposed generally between the upper drill string section 260 and the motor 200. One preferred circulation bypass 300 includes a biased valve member 302 that opens when the flow-rate drops below a predetermined valve. When the valve 302 is open, the supply fluid flows along a channel 304 and exits at ports 306. More generally, the circulation bypass can be configured to actuate upon receiving an actuating signal and/or detecting a predetermined value or range of values relating to a parameter of interest (e.g., flow rate or pressure of supply fluid or operating parameter of the bottomhole assembly). The circulation bypass 300 can be used to facilitate drilling operations and to selective increase the pressure/flow rate of the return fluid.

The motor bypass 310 selectively channels conveys fluid around the motor 200. The motor bypass 310 includes a valve 312 and a passage 314 formed through the motor rotor 202. A joint 316 connecting the motor rotor 202 to the first shaft 242 includes suitable passages (not shown) that allow the supply fluid to exit the rotor passage 314 and enter the supply flow path 290. Likewise, a pump bypass 320 selectively conveys fluid around the pump 220. The pump bypass includes a valve and a passage formed through the pump rotor 222 or housing. The pump bypass 320 can also be configured to function as a particle bypass line for the APD device. For example, the pump bypass can be adapted with known elements such as screens or filters to selectively convey cuttings or particles entrained in the return fluid that are greater than a predetermined size around the APD device. Alternatively, a separate particle bypass can be used in addition to the pump bypass for such a function. Alternately, a valve (not shown) in a pump housing 225 can divert fluid to a conduit parallel to the pump 220. Such a valve can be configured to open when the flow rate drops below a predetermined value. Further, the bypass device can be a design internal leakage in the pump. That is, the operating point of the pump 220 can be controlled by providing a preset or variable amount of fluid leakage in the pump 220. Additionally, pressure valves can be positioned in the pump 220 to discharge fluid in the event an overpressure condition or other predetermined condition is detected.

Additionally, an annular seal 299 in certain embodiments can be disposed around the APD device to direct the return fluid to flow into the pump 220 (or more generally, the APD device) and to allow a pressure differential across the pump 220. The seal 299 can be a solid or pliant ring member, an expandable packer type element that expands/contracts upon receiving a command signal, or other member that substantially prevents the return fluid from flowing between the pump 220 (or more generally, the APD device) and the casing or wellbore wall. In certain applications, the clearance between the APD device and adjacent wall (either casing or wellbore) may be sufficiently small as to not require an annular seal.

During operation, the motor 200 and pump 220 are positioned in a well bore location such as in a casing C. Drilling fluid (the supply fluid) flowing through the upper drill string section 260 enters the motor 200 and causes the rotor 202 to rotate. This rotation is transferred to the pump rotor 222 by the shaft assembly 240. As is known, the respective lobe profiles, size and configuration of the motor 200 and the pump 220 can be varied to provide a selected speed or torque curve at given flow-rates. Upon exiting the motor 200, the supply fluid flows through the supply flow path 290 to the lower drill string section 262, and ultimately the bottomhole assembly (not shown). The return fluid flows up through the wellbore annulus (not shown) and casing C and enters the cutting mill 270 via a inlet 293 for the return flow path 292. The flow goes through the cutting mill 270 and enters the pump 220. In this embodiment, the controller 180 (FIG. 1A) can be programmed to control the speed of the motor 200 and thus the operation of the pump 220 (the APD Device in this instance).

It should be understood that the above-described arrangement is merely one exemplary use of positive displacement motors and pumps. For example, while the positive displacement motor and pump are shown in structurally in series in FIGS. 4A–D, a suitable arrangement can also have a positive displacement motor and pump in parallel. For example, the motor can be concentrically disposed in a pump.

Figure 5A:
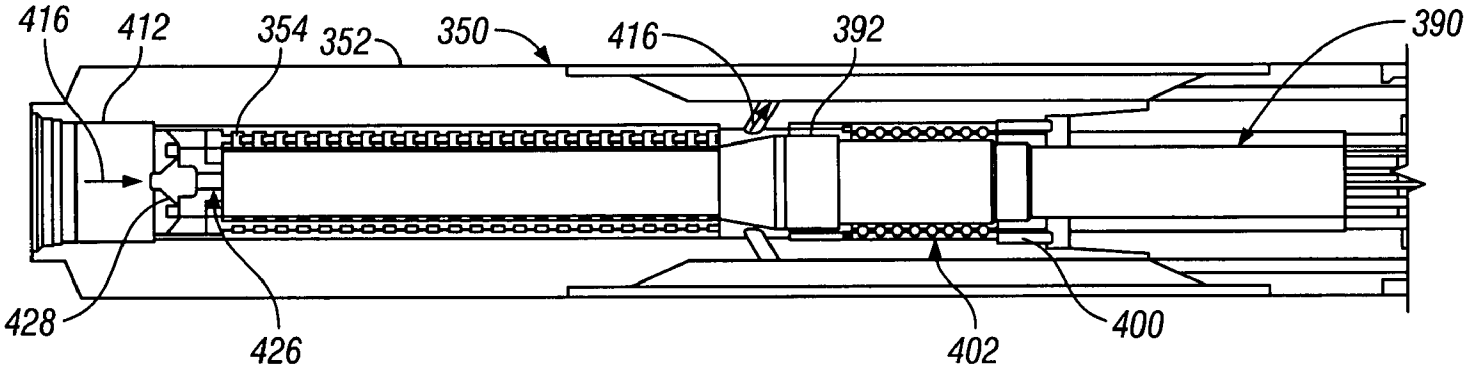
FIGS. 5A and 5B are schematic illustrations of one embodiment of an arrangement according to the present invention wherein a turbine drive is coupled to a centrifugal pump (the APD Device)
Figure 5B:
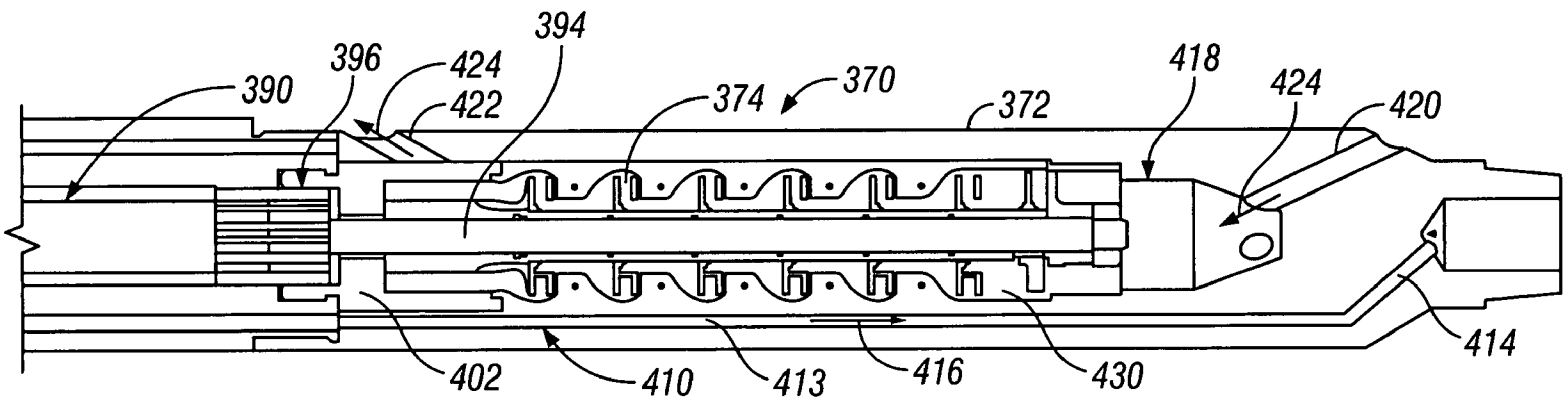

Referring now to FIGS. 5A–B, there is schematically illustrated one arrangement wherein a turbine drive 350 is coupled to a centrifugal-type pump 370 via a shaft assembly 390. The turbine 350 includes stationary and rotating blades 354 and radial bearings 402. The centrifugal-type pump 370 includes a housing 372 and multiple impeller stages 374. The design of turbines and centrifugal pumps are known to one skilled in the art and will not be discussed in further detail.

The shaft assembly 390 transmits the power generated by the turbine 350 to the centrifugal pump 370. One preferred shaft assembly 350 includes a turbine shaft 392 connected to the turbine blade assembly 354, a pump shaft 394 connected to the pump impeller stages 374, and a coupling 396 for joining the turbine and pump shafts 392 and 394.

The FIG. 5A–B arrangement also includes a supply flow path 410 for channeling supply fluid shown by arrows designated 416 and a return flow path 418 to channel return fluid shown by arrows designated 424. The supply flow path 410 includes an inlet 412 directing supply fluid into the turbine 350 and an axial passage 413 that conveys the supply fluid exiting the turbine 350 to an outlet 414. The return flow path 418 includes an inlet 420 that directs return fluid into the centrifugal pump 370 and an outlet 422 that channels the return fluid into the casing C interior or wellbore annulus. A high pressure seal 400 is interposed between the flow paths 410 and 418 to reduce fluid leaks, particularly from the high pressure fluid in the supply flow path 410 into the return flow path 418. A small leakage rate is desired to cool and lubricate the axial and radial bearings. Additionally, a bypass 426 can be provided to divert supply fluid from the turbine 350. Moreover, radial and axial forces can be borne by bearing assemblies 402 positioned along the shaft assembly 390. Preferably a comminution device 373 is provided to reduce particle size entering the centrifugal pump 370. In a preferred embodiment, one of the impeller stages is modified with shearing blades or elements that shear entrained particles to reduce their size. In certain arrangements, a speed or torque converter 406 can be used to convert a first speed/torque of the motor 350 to a second speed/torque for the centrifugal pump 370. It should be understood that any number of arrangements and devices can be used to transfer power, speed, or torque from the turbine 350 to the pump 370. For example, the shaft assembly 390 can utilize a single shaft instead of multiple shafts.

It should be appreciated that a positive displacement pump need not be matched with only a positive displacement motor, or a centrifugal pump with only a turbine. In certain applications, operational speed or space considerations may lend itself to an arrangement wherein a positive displacement drive can effectively energize a centrifugal pump or a turbine drive energize a positive displacement pump. It should also be appreciated that the present invention is not limited to the above-described arrangements. For example, a positive displacement motor can drive an intermediate device such as an electric motor or hydraulic motor provided with an encapsulated clean hydraulic reservoir. In such an arrangement, the hydraulic motor (or produced electric power) drives the pump. These arrangements can eliminate the leak paths between the high-pressure supply fluid and the return fluid and therefore eliminates the need for high-pressure seals. Alternatively, a jet pump can be used. In an exemplary arrangement, the supply fluid is divided into two streams. The first stream is directed to the BHA. The second stream is accelerated by a nozzle and discharged with high velocity into the annulus, thereby effecting a reduction in annular pressure. Pumps incorporating one or more pistons, such as hammer pumps, may also be suitable for certain applications.

Figure 6A:
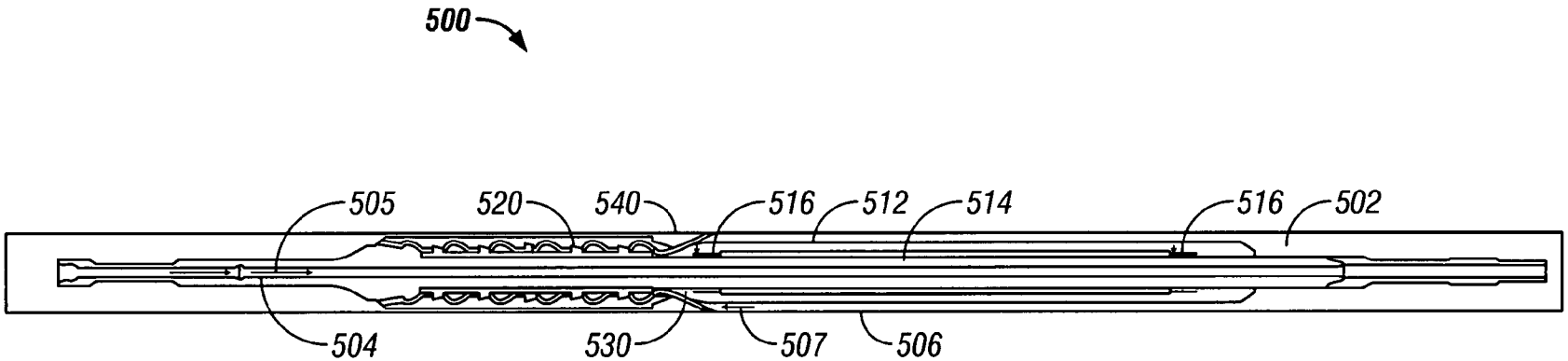
FIG. 6A is a schematic illustration of an embodiment of an arrangement according to the present invention wherein an electric motor disposed on the outside of a drill string is coupled to an APD Device.

Referring now to FIG. 6A, there is schematically illustrated one arrangement wherein an electrically driven pump assembly 500 includes a motor 510 that is at least partially positioned external to a drill string 502. In a conventional manner, the motor 510 is coupled to a pump 520 via a shaft assembly 530. A supply flow path 504 conveys supply fluid designated with arrow 505 and a return flow path 506 conveys return fluid designated with arrow 507. As can be seen, the FIG. 6A arrangement does not include leak paths through which the high-pressure supply fluid 505 can invade the return flow path 506. Thus, there is no need for high pressures seals.

In one embodiment, the motor 510 includes a rotor 512, a stator 514, and a rotating seal 516 that protects the coils 512 and stator 514 from drilling fluid and cuttings. In one embodiment, the stator 514 is fixed on the outside of the drill string 502. The coils of the rotor 512 and stator 514 are encapsulated in a material or housing that prevents damage from contact with wellbore fluids. Preferably, the motor 510 interiors are filled with a clean hydraulic fluid. In another embodiment not shown, the rotor is positioned within the flow of the return fluid, thereby eliminating the rotating seal. In such an arrangement, the stator can be protected with a tube filled with clean hydraulic fluid for pressure compensation.

Figure 6B:
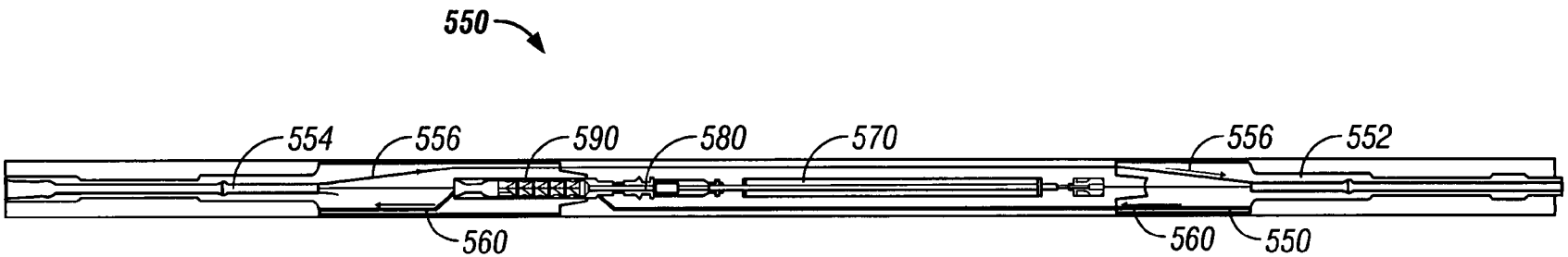
FIG. 6B is a schematic illustration of an embodiment of an arrangement according to the present invention wherein an electric motor disposed within a drill string is coupled to an APD Device.

Referring now to FIG. 6B, there is schematically illustrated one arrangement wherein an electrically driven pump 550 includes a motor 570 that is at least partially formed integral with a drill string 552. In a conventional manner, the motor 570 is coupled to a pump 590 via a shaft assembly 580. A supply flow path 554 conveys supply fluid designated with arrow 556 and a return flow path 558 conveys return fluid designated with arrow 560. As can be seen, the FIG. 6B arrangement does not include leak paths through which the high-pressure supply fluid 556 can invade the return flow path 558. Thus, there is no need for high pressures seals.

It should be appreciated that an electrical drive provides a relatively simple method for controlling the APD Device. For instance, varying the speed of the electrical motor will directly control the speed of the rotor in the APD device, and thus the pressure differential across the APD Device. Further, in either of the FIG. 6A or 6B arrangements, the pump 520 and 590 can be any suitable pump, and is preferably a multi-stage centrifugal-type pump. Moreover, positive displacement type pumps such a screw or gear type or moineau-type pumps may also be adequate for many applications. For example, the pump configuration may be single stage or multi-stage and utilize radial flow, axial flow, or mixed flow. Additionally, as described earlier, a comminution device positioned downhole of the pumps 520 and 590 can be used to reduce the size of particles entrained in the return fluid.

It will be appreciated that many variations to the above-described embodiments are possible. For example, a clutch element can be added to the shaft assembly connecting the drive to the pump to selectively couple and uncouple the drive and pump. Further, in certain applications, it may be advantages to utilize a non-mechanical connection between the drive and the pump. For instance, a magnetic clutch can be used to engage the drive and the pump. In such an arrangement, the supply fluid and drive and the return fluid and pump can remain separated. The speed/torque can be transferred by a magnetic connection that couples the drive and pump elements, which are separated by a tubular element (e.g., drill string). Additionally, while certain elements have been discussed with respect to one or more particular embodiments, it should be understood that the present invention is not limited to any such particular combinations. For example, elements such as shaft assemblies, bypasses, comminution devices and annular seals discussed in the context of positive displacement drives can be readily used with electric drive arrangements. Other embodiments within the scope of the present invention that are not shown include a centrifugal pump that is attached to the drill string. The pump can include a multi-stage impeller and can be driven by a hydraulic power unit, such as a motor. This motor may be operated by the drilling fluid or by any other suitable manner. Still another embodiment not shown includes an APD Device that is fixed to the drill string, which is operated by the drill string rotation. In this embodiment, a number of impellers are attached to the drill string. The rotation of the drill string rotates the impeller that creates a differential pressure across the device.

In certain embodiments of the present invention, one or more of the components described in reference to FIGS. 1A–6B utilize a modular construction. In one aspect, the term modular construction implies a standardized structural configuration having generic or universal coupling interfaces that enables a component to be interchangeable within the wellbore drilling assembly. Thus, for instance, if a component fails or is in need of maintenance, a replacement component is inserted in its place within the drilling assembly. In another aspect, this term implies a component available as a plurality of modules. Each module has a standardized housing for interchangeability while also being functionally or operationally distinct from one another (e.g., each module has different operating set point or operating range and/or different performance characteristics). Thus, as drilling dynamics change, the component module having the appropriate operating or performance characteristics for obtain optimal drilling efficiency is inserted into the wellbore drilling assembly. Still other aspects and advantages of the modular construction will become apparent in the following description.

As is known, a number of factors can affect the overall cost of drilling a wellbore and the quality of the wellbore drilled. Exemplary factors include the lithology of the formation to be drilled, the complexity of the wellbore trajectory, the geographical location (e.g., land-based or offshore), the wellbore environment (e.g., pressure, temperature, etc.), and the operating characteristics and limits of the drilling system.

Conventionally, a wellbore drilling assembly having a substantially fixed or static configuration is used throughout the drilling activity. However, the lithology of a formation can vary from a relatively soft earth that is easy to displace to earth containing hard rock that requires more energy to disintegrate. As is known, adjustments to the drilling parameters to account for changes in lithology can alter the stresses and loadings on the wellbore drilling system as well as impact its efficiency. Also, it is now common for the planned trajectory of a wellbore to deviate from a vertical or plumb line. For instance, the wellbore can include deviated sections, short-radius sections, and horizontal sections in addition to vertical sections. Each such section can impose unique loadings on the wellbore drilling system. One method for accommodating changes in drilling dynamics caused by these and other factors is to adjust certain drilling operating parameters (e.g., weight-on-bit, drilling fluid flow rate, drill bit rotation speed, etc.). Such adjustments, however, may lead to sub-optimal drilling (e.g., reduced rate of penetration) or increased wear on the wellbore drilling assembly components. Another method of dealing with changing drilling dynamics is to include sophisticated control devices (e.g., flow restriction devices and bypass valves) within the wellbore drilling assembly that control the operation of one or more of its constituent components. The use of such control devices can increase the complexity of the wellbore drilling assembly and increase its overall cost.

Figure 7:
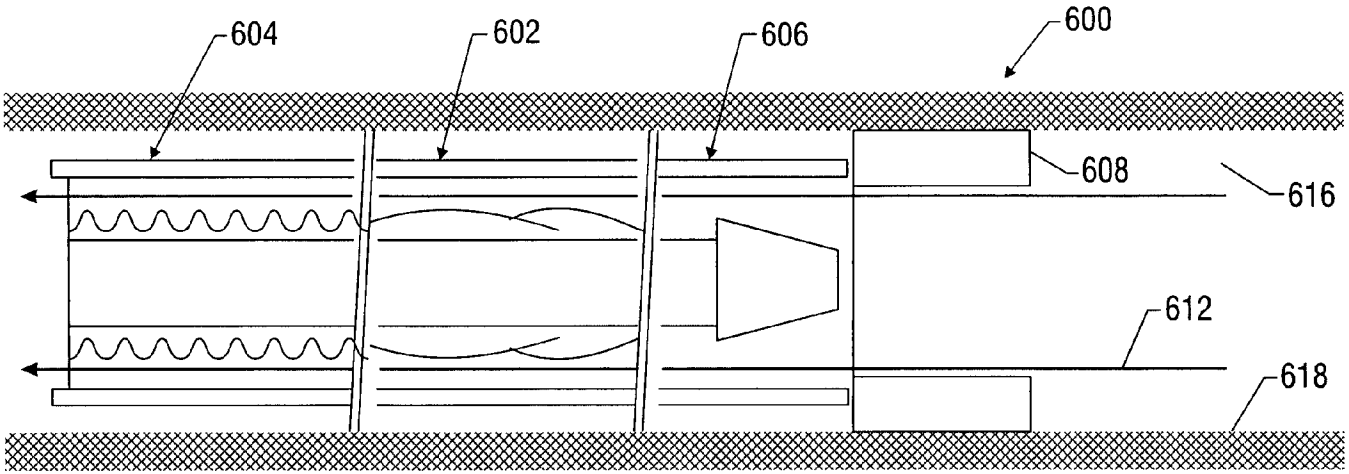
FIG. 7 is a schematic illustration of an embodiment of an arrangement according to the present invention wherein the wellbore drilling system includes at least one modular component.

Referring now to FIG. 7, there is schematically shown a section of a wellbore drilling assembly 600 having a modular APD Device 602 (e.g., a pump), a modular motor 604 driving the modular APD Device 602, a modular comminution device 606, and a modular annular seal 608. The modular construction of these components provides flexibility in assembling a wellbore drilling system 600 that operates optimally in each phase of drilling operations and facilitates the transportation, maintenance and repair of the wellbore drilling system. As will be described below, any one of these above-mentioned modular components can be formed as a plurality of interchangeable units. Each interchangeable unit can have a specified and different operating characteristic. Thus, the drilling assembly 600 can be deployed in multiple configurations, each of which has a selected behavior during operation and a selected response to a given drilling condition.

In one embodiment, the pump 602 is made available in a plurality of interchangeable modular units. Each modular pump 602 is configured to operate a different set points or ranges of set points (e.g., rotational speed, flow rates, pressure differential, etc.). One or more of these modular units can also be fitted with devices (e.g., bypass valves and pressure relief valves) that have different set points. Thus, in instances where a particular drilling environment or operating condition causes the modular pump 602 to operate sub-optimally, that modular pump 602 can be changed out with a modular pump having operating characteristics more suited to the particular conditions encountered. For example, the pump module 602 may be changed out to increase or decrease the pressure differential produced in the return fluid 612. The modular construction can also provide flexibility in designing the drilling assembly. For example, instead of using a single pump 602 to generate a given pressure differential, a plurality of pump 602 modules can be arranged in a serial fashion to generate the given pressure differential across multiple stages. It should be appreciated that pressure differential is merely one operating parameter than can be varied between successive pump modules 602. The configurations of the pump 602 modules can also be designed to account for different compositions of cuttings (e.g., rock size or make-up) in the return fluid 612, the density of the return fluid 612, drilling fluid flow rates, etc.

The motor 604 can also be configured as interchangeable units having specified set point or ranges of set points (e.g., operating RPM and/or torque) and can include control devices having different operating set points. The selection of the appropriate motor module 604 can be based, for example, on the operating requirements of the pump 602, the characteristics of the drilling fluid (e.g., flow rate or pressure), and the wellbore environment (e.g., loadings, temperature, etc.).

Also, in certain embodiments, the pump 602 and motor 604 can be formed as an integral modular unit that can be readily inserted or removed from a wellbore drilling assembly 600. Thus, each integral pump and motor module can be adapted to provide distinct operating characteristics.

As discussed earlier, the comminution device 606 processes entrained cuttings before they enter the pump 602. Like the modular motor 604 and pump 602, the comminution device 606 can be made as a plurality of modules. Each module can be configured for optimal performance under a different operating parameter such a selected flow rate, cutting composition, rotational speed of the driving mechanism, volume of cuttings in the return fluid 612, etc. Additionally, the modular comminution device 606 can be configured to produce different sizes of reduced cuttings. Thus, advantageously, the modular comminution device 606 can be changed-out to match the operating requirements of the pump 602 (e.g., maximum particle size in the return fluid 612 flowing through the pump 602) and/or other devices such as passage ways, valves, and other fluid conduits. It should be noted that the comminution device modules 606 need not be structurally identical. For instance, one module can be configured as a single stage device having one chamber wherein particles are crushed or otherwise reduced in size. Still another module can include a multiple-stage device having multiple chambers in which the particles are successively reduced in size. Nor do the modules need to utilize the same action for reducing particle size. For instance, one module may use a crushing action whereas another module may use a shearing action and still another module utilizes a chemical agent to reduce particle size. Of course, in certain applications, the comminution device 606 can be omitted entirely.

As described earlier, the annular seal 608 selectively blocks flow along the annulus 616 formed between the wellbore drilling assembly 600 and wellbore wall 618 to direct the return fluid 612 into the comminution device 606 (or pump 602 module). As is known, the wellbore drilling assembly 600 can be deployed in wellbores having various diameters. Accordingly, the annular seal 608 can be formed as a plurality of modules, each of which is suited for a specified wellbore diameter or range of wellbore diameters. The annular seal modules 608 can also be formed to handle different wellbore pressures, wellbore fluid chemistry, etc.

Figure 8:
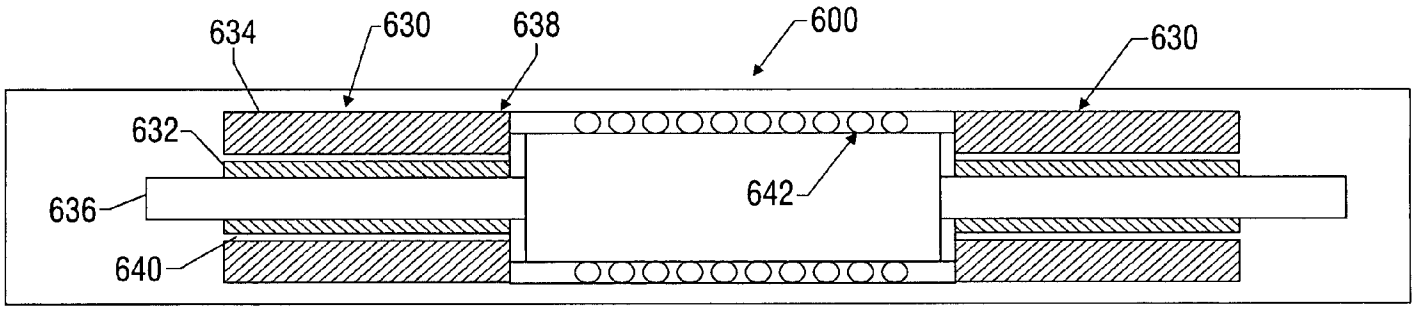
FIG. 8 is a schematic illustration of an embodiment of a modular seal arrangement according to the present invention.

Additionally, features such as valves or safety devices associated with the wellbore drilling system 600 can also be made modular to readily accommodate expected changes in the loadings and operating parameters of the wellbore drilling system 600. Referring now to FIG. 8, there is shown an embodiment of a high-pressure seal 630 that, in one embodiment, is adapted for modular construction. The seal 630 is used in conjunction with a motor 604 and pump 602 and is adapted to prevent the drilling fluid flowing between the stator and rotor of the motor 604 from leaking excessively into a relatively lower pressure region. That is, the seal 630 has a pre-determined leak rate that can be based on one or more operating conditions (discussed below).

In one embodiment, the seal 630 is a hydrodynamic seal that includes a concentrically arranged inner sleeve 632 and outer sleeve 634. The inner sleeve 632 is fixed on a shaft assembly 636 and the outer sleeve 634 is fixed to a housing 638. A gap 640 between the inner sleeve 632 and the outer sleeve 634 is sized to permit a predetermined or specified amount of drilling fluid to leak through between the concentric sleeves 632 and 634. Because the leak rate adversely affects the pressure differential available to drive the motor, one factor in determining the permissible leak rate is amount of pressure and flow rate losses that can be tolerated from a motor efficiency standpoint. Other factors include the amount of fluid needed to cool and lubricate bearings such as axial bearings 642. Because acceptable leak rates can vary depending on the particular drilling conditions, one parameter or operating set point that can be different for the various modules of the seal 630 is leak rates.

Still other parameters or operating conditions can be made different for the various modules of the seal 630. For instance, in the embodiment shown in FIG. 8, the seal 630 is also configured to operate as a radial bearing for providing lateral stability for the motor 604 (FIG. 7). Thus, the modules of the seal 630 can have distinct and different degrees of lateral support. Moreover, although two seals 630 are shown in the FIG. 8 embodiment, other embodiments can use one seal or three or more seal elements.

In one embodiment, the inner and outer sleeves 632, 634 include surfaces adapted to withstand the abrasive operating environment. During operation, the relative rotation between the inner and outer sleeves 602,604 can generate mechanical friction. Moreover, the high velocity of the drilling fluid flowing through the gap 640 can cause wear. Accordingly, surfaces expected to encounter wear from either or both of these sources are hardened. For instance, the outer sleeve can be coated with a relatively hard material (e.g., tungsten carbide) and the inner sleeve can include hardened inserts (e.g., tungsten carbide inserts). Still other treatments (e.g., carburizing, nitriding, etc.) can also be used in certain applications. The sleeves 632,634 can be made modular in form with separate modules. Each high-pressure seal module can be formed to have a different operational characteristics such as leak rate and wear hardness. The modules can also be configured to provide different degrees of radial support. It should be understood, however, that the advantages of the described seal can also be realized in embodiments that do not utilize a modular construction.

In one embodiment, the housings or enclosures of the above-described components utilize a standardized interface. For example, the housing of the components are provided standardized threads on one or more of the opposing ends. Also, the shafts or other members extending between the motor 604 and the pump 602 include complementary male and female connections (not shown). In other embodiments, devices such as flat planes, splines and tongue-and-groove arrangements can also be used. Moreover, a coupling or adapter can be used to join together modules in lieu of (or in addition to) the modules being directly matable with one another.

The operating characteristics, set points and parameters described above are only some of the features that can be varied among the modules of a given component. For instance, the modules can be made to have varying weights, lengths and diameters. The module enclosures and internals can use different materials to have varying resistance to the wellbore environment (wellbore fluids, chemical agents, etc.). Thus, it should be appreciated that in one aspect, what has been described is a wellbore drilling assembly formed of at least one modular component. In one embodiment, the modular and interchangeable component includes a plurality of units, each of which is configured to have a specified operating set points, operating ranges, component dimensions, component weight, and component response to system operating parameters (e.g., flow rates, weight-on-bit, etc.). The modules can have individualized responses to specified wellbore environment or conditions (e.g., stresses, corrosive agents, vibration, etc.). In certain embodiments, the joint arrangement for the modular component includes complementary male and female couplings for connecting features such as shafts and threads on one or both ends of the housing or enclosure.

A number of methodologies may be employed to advantageously apply the above teachings. In one illustrative method, one or more components making up a modular wellbore tool are selected for modular construction. One basis for this selection may be that a certain component may require frequent change-outs (e.g., for maintenance or repair). Another basis may be that the operating capacity or range of a particular component can be extended by use of a modular design. As a first step, the selected components are constructed as modules (e.g., a drive module, a pump module, a comminution device module, annular seal modules, and a high-pressure seal module). A particular component may have a single modular configuration (i.e., each module having the same operating characteristic) or a plurality of modular configurations (i.e., each module having a different operating capacity). In the next step, the individual component modules are assembled as tool sub-modules. For example, a drive module and pump module can be assembled into a first tool sub-module and a comminution device module and annular seal module can be assembled into a second tool module. Much like the individual component modules, the tool sub-modules can each have a specified operating set point, range, characteristic and/or response. Furthermore, the tool sub-modules can be formed to address other factors such as ease of transportation, handling and storage. That is, the tool sub-modules can be constructed to not exceed a particular weight or length so that they may be more easily transported and deployed. Other components such as high-pressure seal modules and modular valve modules can be constructed to be inserted into these or other tool sub-assembly. Finally, the tool sub modules are coupled using a suitable coupling to form a modular tool. It should be appreciated that the operating characteristics of the modular tool can be adjusted by interchanging individual modules (e.g., the pump module) or by interchanging tool sub-modules. Thus, in one process of construction, a modular tool for controlling wellbore pressure is assembled in three steps. First, individual components having specified or discrete functions are formed as modular units. Second, these modular units are formed into tool sub-modules. And third, the tool sub-modules are assembled into the modular tool. It should be appreciated that the modular construction not only enhances the overall operating capacity of the modular tool, but simplifies assembly, dis-assembly, repair, maintenance, handing, shipment and storage.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A drilling system for drilling a wellbore, comprising (a) a drill string having a drill bit at an end thereof;

(b) a source supplying drilling fluid under pressure into the drill string (a "supply fluid"), the drilling fluid returning uphole via an annulus around the drill string (a "return fluid");

(c) a modular tool in communication with the return fluid for reducing pressure in the wellbore downhole of the modular tool, said modular tool having at least one interchangeable modular unit;

(d) an active pressure differential device ("APD Device") associated with the modular tool to create a pressure drop across said APD Device; and (e) a drive assembly coupled to said APD Device for energizing said APD Device.

2. The system according to claim (1) wherein said modular unit is provided as a plurality of modular units, each of which are interchangeable with the other and each of which has a substantially different value for a selected operating parameter.

3. The system according to claim (1) wherein said APD Device is said modular unit.

4. The system according to claim (3) further comprising a plurality of said modular units, each of said modular units being configured to have a substantially different value for a selected operating parameter.

5. The system according to claim (4) wherein said selected operating parameter includes (i) pressure differential in the return fluid; (ii) rotation speed; (iii) flow rate; and (iv) torque.

6. The system according to claim (1) wherein said drive assembly is said modular unit.

7. The system according to claim (6) further comprising a plurality of said modular units, each of said modular units being configured to have a substantially different value for a selected operating parameter.

8. The system according to claim (7) wherein said selected operating parameter is one of (i) differential pressure of the supply fluid; (ii) rotation speed; (iii) flow rate; and (iv) torque.

9. The system according to claim (1) further comprising a comminution device for reducing the size of particles entrained in the return fluid, said comminution device being said modular unit.

10. The system according to claim (1) further comprising a high-pressure seal for controlling the leaking of pressurized drilling fluid from said modular tool, said high-pressure seal being said modular unit.

11. The system according to claim (1) further comprising an annular seal for directing return fluid into said modular tool, said annular seal being said modular unit.

12. A drilling system for drilling a wellbore, comprising
(a) a drill string having a drill bit at an end thereof;
(b) a source of drilling fluid supplying drilling fluid under pressure into the drill string (a "supply fluid"), the drilling fluid returning uphole via an annulus around the drill string (a "return fluid");
(c) an active pressure differential device ("APD Device") associated with the return fluid to create a pressure drop across said APD Device to reduce pressure in the wellbore downhole of the APD Device;
(d) a drive assembly coupled to said APD Device for energizing said APD Device; and
(e) a high-pressure seal associated with said drive assembly, said seal configure to provide a controlled leakage of pressurized drilling fluid out of said drive assembly.

13. The drilling system according to claim (12) wherein said high-pressure seal is configured to operate as a radial bearing for providing lateral stability a shaft associated with said drive assembly.

14. The drilling system according to claim (12) wherein said high-pressure seal comprises a plurality of seal elements.

15. The drilling system according to claim (12) wherein said high-pressure seal is configured to provide a leak rate of fluid for cooling and lubricating a bearing.

16. The drilling system according to claim (12) wherein said high-pressure seal comprises a concentrically arranged inner sleeve and outer sleeve, said inner sleeve being fixed on a shaft assembly associated with the drive assembly and said outer sleeve being fixed to a housing associated with the drive assembly.

17. The drilling system according to claim (12) wherein said high-pressure seal includes one of (i) a hardened surface, and (ii) a hardened insert to reduce frictional wear.

18. The drilling system according to claim (12) wherein said high-pressure seal is formed as a modular unit.

19. A method of constructing a tool for reducing pressure in the wellbore downhole of the modular tool, comprising:
(a) providing a plurality of modular units, said modular units being selected from a group consisting of: (i) an active pressure differential device module (APD device module) for creating a pressure differential in a fluid returning from a drill bit; (ii) a drive module for energizing the APD Device module; (iii) a comminution device module for reducing the size of cutting in the wellbore; (iv) an annular seal module for directing fluid into the APD Device module; and (v) a high-pressure seal module for substantially sealing a pressurized fluid in the drive module;
(b) assembling the plurality of modular units into a plurality of tool sub-assemblies; and
(c) assembling the plurality of tool sub-assemblies into a modular tool for reducing pressure in the wellbore downhole of the modular tool.

20. A method for drilling a wellbore, comprising
(a) providing a drill string having a drill bit at an end thereof;
(b) supplying drilling fluid under pressure into the drill string (a "supply fluid"), the drilling fluid returning uphole via an annulus around the drill string (a "return fluid");
(c) positioning a modular tool in communication with the return fluid for reducing pressure in the wellbore downhole of the modular tool, said modular tool having at least one interchangeable modular unit;
(d) creating a pressure drop in the return fluid using an active pressure differential device ("APD Device") associated with the modular tool; and
(e) energizing the APD Device with a drive assembly.

21. The method according to claim (19) wherein said modular unit is provided as a plurality of modular units, each of which are interchangeable with the other and each of which has a substantially different value for a selected operating parameter.

22. The method according to claim (19) further comprising forming the APD Device as the modular unit.

23. The method according to claim (21) further comprising forming the APD Device as a plurality of modular units, each of the modular units being configured to have a substantially different value for a selected operating parameter selected from one of (i) pressure differential in the return fluid; (ii) rotation speed; (iii) flow rate; and (iv) torque.

24. The method according to claim (19) further comprising forming the drive assembly as the modular unit.

25. The method according to claim (21) further comprising forming the modular units as a plurality modular units, each of said modular units being configured to have a substantially different value for a selected operating parameter selected from one of (i) differential pressure of the supply fluid; (ii) rotation speed; (iii) flow rate; and (iv) torque.

26. The method according to claim (19) wherein the modular unit is selected from one of (i) a comminution device for reducing the size of particles entrained in the return fluid, (ii) a high-pressure seal for minimizing the leaking of pressurized drilling fluid from the modular tool, and (iii) an annular seal for directing return fluid into the modular tool.

27. A method for drilling a wellbore, comprising
(a) a drill string having a drill bit at an end thereof;
(b) supplying drilling fluid under pressure into the drill string (a "supply fluid"), the drilling fluid returning uphole via an annulus around the drill string (a "return fluid");
(c) positioning an active pressure differential device ("APD Device") in communication with the return fluid to create a pressure drop across said APD Device to reduce pressure in the wellbore;
(d) energizing the APD Device with a drive assembly coupled to the APD Device; and
(e) sealing the pressurized drilling fluid in the drive assembly using a high-pressure seal having a predetermined rate of leakage.

28. The method according to claim (26) further comprising providing lateral stability for a shaft associated with the drive assembly using the high-pressure seal.

29. The method according to claim (26) further comprising cooling and lubricating a bearing using the drilling fluid leaked through the high-pressure seal.

30. The method according to claim (26) wherein the high-pressure seal comprises a concentrically arranged inner sleeve and outer sleeve, the inner sleeve being fixed on a shaft assembly associated with the drive assembly and the outer sleeve being fixed to a housing associated with the drive assembly.

* * * * *